United States Patent [19]

Shiga et al.

[11] Patent Number: 4,477,280

[45] Date of Patent: Oct. 16, 1984

[54] HEAT RESISTING STEEL

[75] Inventors: Masao Shiga; Seishin Kirihara, both of Hitachi; Mitsuo Kuriyama, Ibaraki; Takatoshi Yoshioka; Ryoichi Sasaki, both of Hitachi, all of Japan

[73] Assignee: Hitachi, Ltd., Tokyo, Japan

[21] Appl. No.: 452,292

[22] Filed: Dec. 22, 1982

[30] Foreign Application Priority Data

Dec. 25, 1981 [JP] Japan ..... 56-210950

[51] Int. Cl.[3] ..... C22C 38/06

[52] U.S. Cl. ..... 75/124; 75/126 C; 75/126 J; 75/128 N; 75/128 W; 148/37

[58] Field of Search ..... 75/126 C, 126 E, 126 F, 75/128 G, 128 W, 128 V, 128 N, 124 C, 124 R; 148/37

[56] References Cited

U.S. PATENT DOCUMENTS 2,848,323 8/1958 Harris et al. ..... 75/124 C
2,880,085 3/1959 Kirby et al. ..... 75/126 C
3,139,337 6/1964 Boyle et al. ..... 75/126 C
3,767,390 10/1973 Hahn ..... 75/128 W

FOREIGN PATENT DOCUMENTS 0110758 8/1980 Japan ..... 75/128 W

*Primary Examiner*—L. Dewayne Rutledge
*Assistant Examiner*—Debbie Yee
*Attorney, Agent, or Firm*—Antonelli, Terry & Wands

[57] ABSTRACT

A heat resisting steel suitable for use as material of steam turbine parts. The steel has a substantially whole tempered martensite structure and consisting essentially of, by weight, 8 to 13% of Cr, 0.5 to 2% of Mo, 0.02 to 0.5% of V, 0.02 to 0.15% of Nb, 0.025 to 0.1% of N, 0.05 to 0.25% of C, not greater than 0.6% of Si, not greater than 1.5% of Mn, not greater than 1.5% of Ni, 0.0005 to 0.02% of Al, 0.1 to 0.5% of W and the balance substantially Fe, the ratio W/Al between W content and Al content ranging between 10 and 110.

16 Claims, 14 Drawing Figures

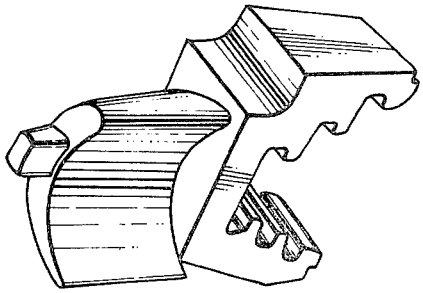
FIG. 13
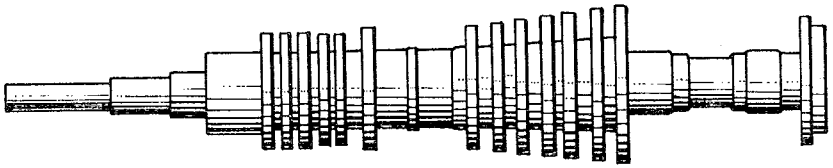
FIG. 14
FIG. 12
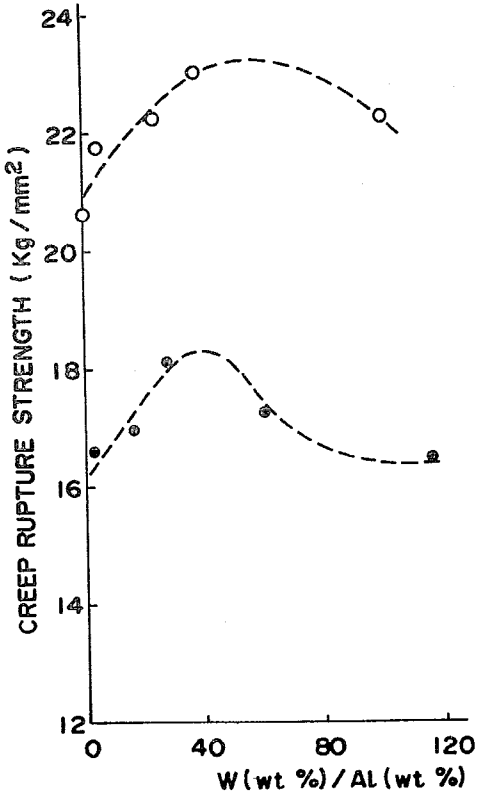

HEAT RESISTING STEEL

BACKGROUND OF THE INVENTION

The present invention relates to a novel heat resisting steel and, more particularly, to a heat resisting steel suitable for use as the material of blades or rotors of a steam turbine exhibiting a high creep rupture strength and toughness at temperatures ranging between 550° and 600° C. and having a uniform tempered martensite structure.

In recent years, there is a remarkable increase in the steam temperature and pressure at which steam turbines operate. In fact, in some steam turbines, the steam temperature and pressure well reach 566° C. and 246 atg, blades and rotor shaft, therefore are required to withstand this severe condition of use. To meet this demand, hitherto, a steel called crucible 422 steel (12Cr1MoW$\frac{1}{4}$V steel) or a steel called H46 steel (12CrMoNbV steel) has been used advantageously as the material of steam turbine blades, whereas 1Cr-1Mo-$\frac{1}{4}$V steel, as well as 11Cr-1Mo-$\frac{1}{4}$V-Nb-N steel disclosed in the specification of the U.S. Pat. No. 3,139,337 has been used as the material of the rotor shaft.

On the other hand, there is a continuous and drastic rise of cost of fossil fuels such as petroleum, coal and so forth. As a result, it is becoming important more and more to increase the power generating efficiency of a power generating plant making use of such fossil fuel. For increasing the power generating efficiency, it is essential to increase the steam temperature or pressure at which the turbine operates. Unfortunately, however, known materials for steam turbines cannot be used satisfactorily under such severe conditions. Even the alloy steels mentioned above could not meet such a requirement due to insufficient high temperature strength and toughness.

Under these circumstances, there is an increasing demand for development of a material for steam turbines, having a superior high temperature strength and toughness.

SUMMARY OF THE INVENTION

Accordingly, it is a primary object of the invention to provide a heat resisting steel having a superior high temperature strength without any reduction in the toughness at low temperature and, more particularly, to provide a heat resisting steel having a superior high temperature strength suitable for use as the material of rotor shafts and blades of steam turbines.

To this end, according to the invention, there is provided a heat resisting steel having a whole tempered martensite structure and consisting essentially of, by weight, 8 to 13% of Cr, 0.5 to 2% of Mo, 0.02 to 0.5% of V, 0.02 to 0.15% of Nb, 0.025 to 0.1% of N, 0.05 to 0.25% of C, not greater than 0.6% of Si, not greater than 1.5% of Mn, not greater than 1.5% of Ni, 0.0005 to 0.02% of Al, 0.1 to 0.5% of W and the balance substantially Fe, the ratio W/Al between W content and Al content ranging between 10 and 110.

Other objects, features and advantages of the invention will become clear from the following description of the preferred embodiment taken in conjunction with the accompanying drawings.

BRIEF DESCRIPTION OF THE DRAWINGS

FIG. 12 is a diagram showing the relationship between the creep rupture strength and the ratio (W/Al);

FIG. 13 is a perspective view of an example of a steam turbine blade made of a heat resisting steel embodying the present invention; and FIG. 14 is a perspective view of an example of a steam turbine rotor shaft made of a heat resisting steel embodying the present invention.

DESCRIPTION OF THE PREFERRED EMBODIMENT

Figure 2:
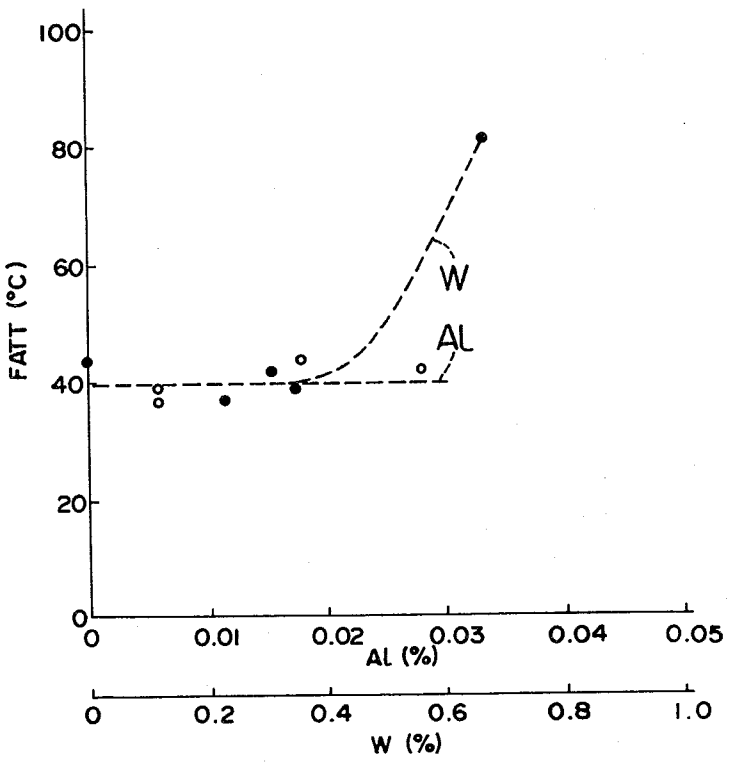
FIG. 2 is a diagram showing how FATT is changed by a change in Al and W contents.

The present invention is based upon the discovery of a fact that the high-temperature long-time creep rupture strength of a high Cr martensitic alloy steel having optimum C,Si,Ni,Mo,V,Nb and N contents can be remarkably improved without causing any reduction in the toughness, by addition of an extremely small amount of Al and a small amount of W at a predetermined ratio W/Al between the W and the Al contents.

According to an aspect of the invention, a steam turbine rotor shaft is preferably made of a steel having a whole tempered martensite structure and consisting essentially of, by weight, 8 to 13% of Cr, 0.5 to 2% of Mo, 0.02 to 0.5% of V, 0.02 to 0.12% of Nb, 0.025 to 0.1% of N, 0.1 to 0.25% of C, not greater than 0.6% of Si, not greater than 1.5% of Ni, not greater than 1.5% of Mn, 0.0005 to 0.01% of Al, 0.1 to 0.5% of W and the balance Fe, the ratio W/Al between the W content and Al content ranging between 10 and 110.

According to another aspect of the invention, a steam turbine blade is preferably made of a steel having a whole tempered martensite structure and consisting essentially of, by weight, 8 to 13% of Cr, 0.5 to 2% of Mo, 0.02 to 0.5% of V, 0.05 to 0.03% of Nb, 0.025 to 0.1% of N, 0.05 to 0.2% of C, not greater than 0.6% of Si, not greater than 1.5% of Ni, not greater than 1.5% of Mn, 0.0005 to 0.015% of Al, 0.1 to 0.5% of W and the balance Fe, the ratio W/Al between the W content and Al content ranging between 10 and 110.

At least 0.05% of C is essential for obtaining sufficiently high tensile strength. However, a C exceeding 0.25% makes the structures unstable when the steel is structured to a high temperature for a long time to decrease the long-time creep rupture strength undesirably. The C content, therefore, should be selected to fall within the range between 0.05 and 0.25%, preferably between 0.1 and 0.2%. More specifically, the C content of the steel for the steam turbine blade should be selected to range between 0.1 to 0.16%, while the C content of the steel for rotor shaft should be selected to range between 0.14 and 0.22%.

The Nb is an element which is highly effective for improving the high-temperature strength. A too large Nb content, however, causes a precipitation of coarse Nb carbides and lowers the C content in the matrix, resulting in a reduction in the strength and unfavourable precipitation of the δ ferrite which lowers the fatigue strength undesirably. The Nb content, therefore, should not exceed 0.15%. The effect of Nb, however, is insufficient when the Nb content is less than 0.02%. More specifically, the Nb content of the steel for steam turbine blade should be selected to range between 0.05 and 0.15%, and the Nb content of the steel for rotor shaft should be selected to range between 0.03 and 0.10%.

The N is an element which is effective in improving the creep rupture strength and in preventing the generation of the δ ferrite. The effect of N, however, is not appreciable when the N content is below 0.025%. On the other hand, an N content in excess of 0.1% seriously decreases the toughness. Preferably, the N content is selected to range between 0.04 and 0.07%.

The Cr contributes to the improvement in the high temperature strength. A Cr content exceeding 13%, however, causes a generation of δ ferrite. On the other hand, a Cr content not greater than 8% cannot ensure sufficient corrosion resistance against the steam of high temperature and pressure. Preferably, the Cr content is selected to range between 10 and 11.5%.

The V is an element which is effective in increasing the creep rupture strength. A V content not greater than 0.02% cannot provide sufficient effect, whereas a V content exceeding 0.5% permits the generation of δ ferrite resulting in a reduced fatigue strength. The V content, therefore, should be selected to range between 0.1 and 0.3%.

The Mo contributes to the improvement in the creep strength through solid solution strengthening and precipitation hardening. The effect of Mo, however, is not appreciable when the Mo content is below 0.5%. On the other hand, an Mo content exceeding 2% permits the generation of δ ferrite to reduce the toughness and the creep rupture strength. The Mo content is selected to range preferably between 0.75 and 1.5% and more preferably between 1 and 1.5%.

The Ni is an element which is effective in increasing the toughness and in preventing the generation of δ ferrite. An Ni content exceeding 1.5%, however, is not preferred because it decreases the creep rupture strength undesirably. The Ni content preferably ranges between 0.3 and 1%.

The Mn is added as a deoxidizer. The deoxidation can be achieved even by the addition of small amount of Mn. On the other hand, the addition of Mn in excess of 1.5% reduces the creep rupture strength. Especially, the Mn content between 0.5% and 1% is preferable.

The Si also is added as a deoxidizer. The deoxidation by Si, however, is unnecessary according to a steel making technic such as vacuum C deoxidation. On the other hand, a reduction in the Si content is effective in preventing the precipitation of δ ferrite and improvement in the toughness. The Si content, therefore, should be limited to be not greater than 0.6%. If the addition of Si is necessary, the Si content preferably ranges between 0.02 and 0.25%, more preferably between 0.02 and 0.1%.

The W is an element which can remarkably improve the high temperature strength even by small amount. The effect of addition of W, however, is not appreciable when the W content is below 0.1%. In addition, the strength is drastically decreased as the W content is increased beyond 0.5%. The W content, therefore, should be selected to range between 0.1 and 0.5%. It is also to be noted that the toughness is seriously decreased when the W content is increased in excess of 0.5%. Therefore, the W content is preferably not greater than 0.5%, particularly in the material which is required to have specifically high toughness. Namely, in such a use, the W content is selected preferably to range between 0.2 and 0.45%, more preferably between 0.2 and 0.3%.

The Al is an element which serves as an effective deoxidizer. For attaining an appreciable effect, the Al content is selected to be not smaller than 0.0005% but not greater than 0.02%. Any Al content exceeding 0.02% acts to reduce the high temperature strength. Preferably, the Al content is selected to range between 0.001 and 0.01%.

The stability of a metallurgical structure when heated at a high temperature for a long time is remarkably improved to ensure a remarkable improvement in the high-temperature long-time creep rupture strength without being accompanied by a reduction in the toughness at low temperature, by adding 0.1 to 0.5% of W and selecting the Al content to range between 0.0005 and 0.02%, while maintaining the ratio W/Al between the W content and the Al content within the range between 10 and 110. The ratio W/Al is more preferably selected to range between 20 and 80 and most preferably between 30 and 60. Generally speaking, the high creep rupture strength and the high toughness are incompatible with each other. Namely, a reduction in the toughness is usually unavoidable when the creep rupture strength is increased. In this connection, it was confirmed that according to the invention the creep rupture strength can be improved without any deterioration in the toughness. Since the affinity of W for carbon is less than that of Nb and V, the formation of W carbides is liable to be influenced by the Al in the alloy. It has been confirmed that since the Al serves to promote the formation of carbides, it effectively affects in forming carbides on the elements having small affinity for C. Thus, it has been confirmed that the ratio W/Al between the W content and Al content is an important factor which rules the high temperature strength. A value of the ratio W/Al less than 10 in terms of weight percent cannot provide sufficient formation of carbides and, hence, cannot provide sufficient effect on the high temperature strength. On the other hand, when the ratio W/Al takes a value exceeding 110, the effect on carbide formation is decreased to make it impossible to obtain superior high temperature strength and high toughness.

The Mo,W and C contents are preferably adjusted such that a value given by Mo(wt%)+3W(wt%) ranges between 1.4 and 2.6 and that a value given by [3Mo(wt%)+W(wt%)]/C(wt%) is not greater than 34.

The Mo is an element which has a small ability for forming carbides, as in the case of the W. However, by the action of the Al, the formation of carbides is promoted to afford a remarkable improvement in the high temperature strength. Preferably, the value given by Mo+3W is selected to range between 1.8 and 2.2.

It is also preferred that a ratio expressed by Al(wt%)/N(wt%) is selected to be not greater than 0.5 because, by so doing, it is possible to increase the stability of carbides at high temperature and, hence, to obtain higher creep rupture strength, thanks to the solid solution strengthening of nitrogen and to dispersion strengthening of $Cr_2N$.

The heat resisting alloy of the invention has a materially whole tempered martensite structure. In this type of alloy steel, δ ferrite is often formed in dependence on the composition thereof. In order to obtain the desired superior high temperature strength, it is necessary to select a composition which materially prohibits the formation of δ ferrite. The control of the amount of the δ ferrite can be made through the control of the chromium equivalent which is determined by the following equation:

$$\text{Chromium Equivalent} = -40\times C(\%) - 30\times N(\%) - 2\times Mn(\%) - 4\times Ni(\%) + Cr(\%) + 6\times Si(\%) + 4\times Mo(\%) + 1.5\times W(\%) + 11\times V(\%) + 5\times Nb(\%)$$

According to the invention, the contents of the elements constituting the heat resisting steel are selected such that the above-mentioned chromium equivalent takes a value less than 12. In the case of the material for the stream turbine blade, the chromium equivalent is more preferably selected to range between 6 and 12 and most preferably between 9 and 11. In the case of the material for the rotor shaft, the chromium equivalent is selected more preferably to be not greater than 10.5, particularly between 4 and 9.5, and most preferably between 6.5 and 9.5.

The generation of δ ferrite causes a reduction in the fatigue strength and toughness. It is, therefore, necessary that the heat resisting steel of the invention has a uniform tempered martensite structure. To this end, the stream turbine blade made from the heat resisting steel of the invention is preferably tempered after an oil quenching, while the rotor shaft is tempered after a quenching which is conducted at a cooling rate greater than 100° C./h.

EXAMPLE 1

Steel ingots were made using a high-frequency induction melting furnace, and were heated up to 1150° C. The ingots were then hot forged and elongated into pieces of 35 mm×115 mm×1. Chemical compositions (wt%) of typical samples are shown in Table 1. In each chemical composition, the balance was constitued by Fe. The sample No. 1 is a material corresponding to the crucible 422, while the sample No. 2 is a material corresponding to H46, both of which were prepared by melting for comparison with the materials of the invention which are indicated at samples Nos. 3 and 4. Sample Nos. 5 and 6 are comparison materials in which the Al content and W content are increased, respectively.

Table 2 shows the conditions of heat treatment effected on the sample, same as those of the heat treatment applied to the steam turbine blades. More specifically, the sample No. 1 is tempered at 630° C. after an oil quenching from a temperature of 1050° C., while samples Nos. 2 to 6 were tempered at 650° C. after an oil quenching from 1100° C. Table 3 shows mechanical properties. In this Table, the term FATT (Fracture Appearance Transition Temperature) is used to mean the 50% fracture transition temperature at which the fracture of the sample after an impact test exhibits 50% ductile fracture and 50% brittle fracture. The lower value of FATT, i.e. the lower 50% fracture transition temperature, means a higher toughness.

As will be seen from Table 3, the materials of the invention exhibits creep rupture strength (600° C., $10^5$ h) ranging between 14.2 and 14.5 Kg/mm$^2$ which exceeds the value 11.5 Kg/mm$^2$ necessitated by the material of parts of steam turbine which is designed to operate with a high efficiency, and much more greater than those of the known blade material sample Nos. 1 (6.4 Kg/mm$^2$) and 2 (9.1 Kg/mm$^2$). It will be seen also that the toughness, i.e. the impact strength and the FATT, is equivalent to or greater than those of the known materials. From these facts, it will be said that the heat resisting steel of the invention can suitably be used as the materials for blades of steam turbines which operate with steam of a high temperature and pressure.

The long-time creep rupture strength is low in the material having an Al content exceeding 0.02%, e.g. the sample No. 5. It is not possible to fulfill the object of the invention with such a material. In the material of the sample No. 6 precipitation of δ ferrite is caused due to an excessively large W content, so that the toughness is decreased undesirably. Also, the creep rupture strength of this material is lower than that of the heat resisting steel of the invention.

TABLE 1

| No. | C | Si | Mn | Ni | Cr | Mo | V | Nb | N | W | Al | Cr Equivalent | W/Al |
|---|---|---|---|---|---|---|---|---|---|---|---|---|---|
| 1 | 0.26 | 0.40 | 0.72 | 0.70 | 12.13 | 1.02 | 0.24 | — | 0.021 | 0.94 | 0.024 | 7.39 | — |
| 2 | 0.16 | 0.46 | 0.62 | 0.58 | 11.20 | 1.05 | 0.23 | 0.46 | 0.053 | — | 0.018 | 11.44 | 0 |
| 3 | 0.12 | 0.21 | 0.55 | 0.66 | 11.15 | 1.24 | 0.22 | 0.09 | 0.050 | 0.23 | 0.006 | 10.55 | 38.3 |
| 4 | 0.13 | 0.09 | 0.60 | 0.49 | 11.03 | 1.16 | 0.23 | 0.11 | 0.047 | 0.35 | 0.006 | 10.05 | 58.3 |
| 5 | 0.14 | 0.21 | 0.62 | 0.61 | 11.05 | 1.28 | 0.20 | 0.08 | 0.052 | 0.31 | 0.028 | 9.66 | 11.1 |
| 6 | 0.12 | 0.23 | 0.59 | 0.64 | 11.13 | 1.26 | 0.23 | 0.09 | 0.046 | 0.67 | 0.007 | 11.66 | 95.7 |

TABLE 2

| No. | heat treatment: quenching | heat treatment: tempering |
|---|---|---|
| 1 | 1050° C. × 1h oil quench | 630° C. × 2h furnace cooling |
| 2–6 | 1100° C. × 1h oil quench | 650° C. × 2h furnace cooling |

TABLE 3

| No. | tensile strength (Kg/mm²) | elon-ga-tion (%) | reduc-tion of area (%) | impact strength (Kg-m) | FATT (°C.) | 600° C., 10⁵h creep rupture strength (Kg/mm²) |
|---|---|---|---|---|---|---|
| 1 | 102.0 | 15.4 | 43.0 | 2.0 | 57 | 6.4 |
| 2 | 104.1 | 19.8 | 59.9 | 3.1 | 43 | 9.1 |
| 3 | 106.6 | 20.4 | 59.1 | 3.4 | 36 | 14.5 |
| 4 | 106.1 | 20.2 | 58.5 | 3.3 | 38 | 14.2 |
| 5 | 106.3 | 20.1 | 58.3 | 3.1 | 41 | 11.5 |
| 6 | 102.4 | 19.5 | 56.5 | 1.9 | 80 | 12.0 |

Figure 1:
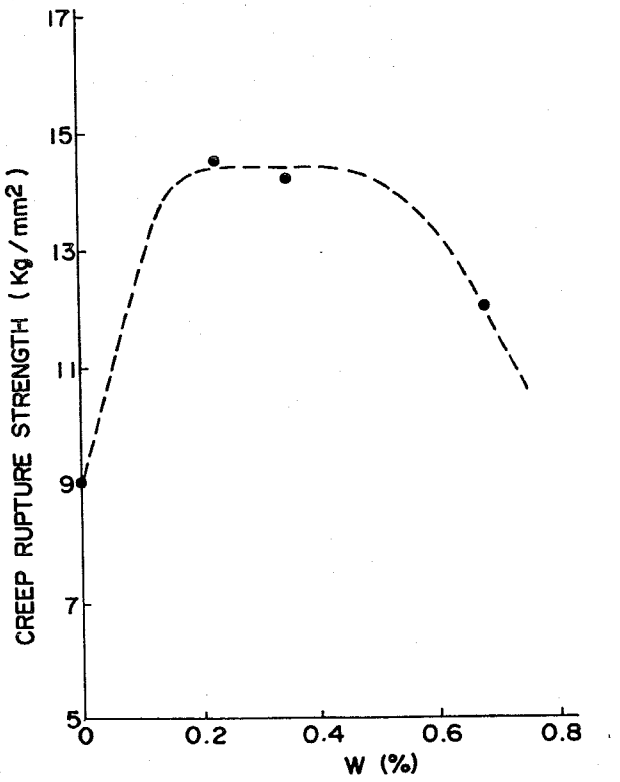
FIG. 1 is a diagram showing how the creep rupture strength (600° C., $10^5$ hours) is changed in accordance with a change in the W content.

FIG. 1 is a diagram showing how the creep rupture strength (600° C., $10^5$ h) of an alloy containing 0.006 to 0.018% of Al is influenced by the W content. From this Figure, it will be seen that the strength is increased remarkably as the W content is increased beyond 0.1% but is drastically lowered as the W content exceeds 0.65%. The effect of W is remarkable particularly within the range between 0.2 and 0.45%.

FIG. 2 is a diagram showing the effect of Al on the FATT in an alloy containing 0 to 0.35% of W, as well as the effect of W on the FATT in an alloy containing 0.006 to 0.028% of Al. The Al itself does not affect the FATT so strongly. On the other hand, W content exceeding 0.5% causes a remarkable increase in the FATT to reduce the toughness.

EXAMPLE 2

Steel ingots were made using a high-frequency induction melting furnace. The ingots were heated to 1150° C. and then forged to become an experimental materials. Test materials were cut out from these materials and, after effecting a heat treatment simulating that for the central portion of steam turbine rotor, test pieces for the tensile test, impact test and creep rupture test were cut out from the test materials in the direction perpendicular to the forging direction. Table 4 shows the chemical compositions (wt %) of representative samples. In each sample, the balance of composition is constituted by Fe. Samples Nos. 1A,2B and 2C are materials corresponding to the conventional rotor material ASTM470-Class 8 and 11Cr1MoVNbN steel. Samples Nos. 3C,4C,5C and 7C are the materials in accordance with the invention. Sample No. 6C is a reference material for comparison. Table 5 shows conditions of heat treatment effected on the samples. The quenching was made at a rate of 100° C./h, simulating the condition of quenching of the central portion of the large-size rotor. Table 6 shows mechanical properties in which FATT represents the 50% fracture transition temperature. The lower the 50% fracture transition temperature is, the higher the toughness becomes. From this Table, it will be seen that the materials of the invention exhibit creep rupture strengths (600° C., $10^5$ h) on the order of 11 Kg/mm² which well exceeds 10 Kg/mm² essential in the materials for parts of steam turbine which is designed to operate at a high efficiency and is much higher than 4.6 Kg/mm² exhibited by the known turbine rotor material Cr-Mo-V steel and 8.5 Kg/mm² exhibited by the known turbine rotor material 11Cr1MoVNbN steel. It is understood also that the toughness of the materials of the invention is apparently superior to those of the known materials samples Nos. 1A and 2B. Thus, the heat resisting steel of the invention is quite suitable for use as the material for rotor shaft of steam turbines which operate with steam of high temperature and pressure.

When the Al content is increased beyond 0.015% as in the case of the sample No. 5C, the creep rupture strength ($10^5$ Hours) is reduced down to a level below 11 Kg/mm². It is to be pointed out also that, when the W content is excessively large as in the case of the sample No. 6C, the toughness is reduced undesirably due to precipitation of δ ferrite. Thus, it is not possible to satisfy the object of the invention with such materials as samples Nos. 5C and 6C.

Figure 3:
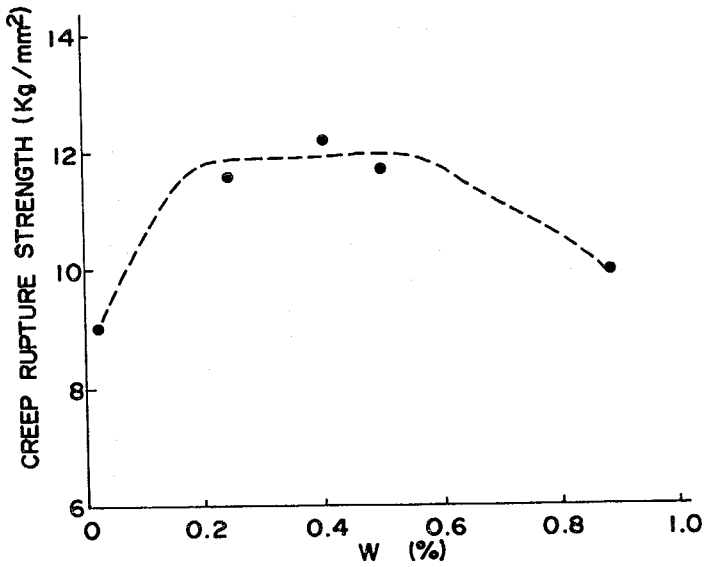
FIG. 3 is a diagram showing how the creep rupture strength (600° C., $10^5$ hours) is changed in accordance with a change in the W content.

FIG. 3 is a diagram showing how the creep rupture strength (600° C., $10^5$ h) is influenced in an alloy containing 0.008 to 0.012% of Al by the W content. As will be seen from this Figure, a high strength is obtained when the W content ranges between 0.1 and 0.65%.

Figure 4:
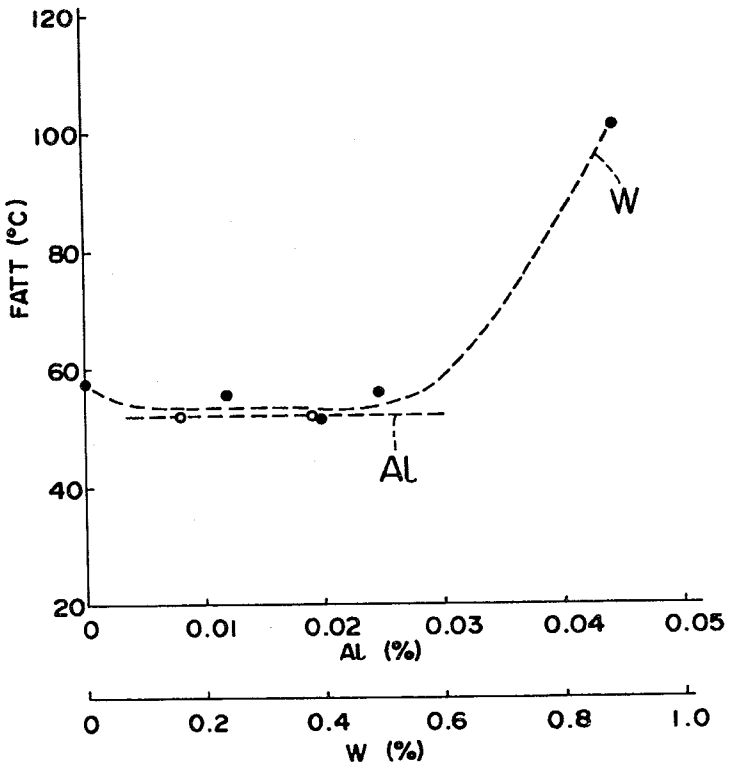
FIG. 4 is a diagram showing how FATT is changed by a change in Al and W contents.

FIG. 4 is a diagram showing how the FATT of an alloy containing 0.40 to 0.41% of W is influenced by Al, as well as how the FATT of an alloy containing 0.008 to 0.012% of Al is influenced by W. From this Figure, it will be understood that the FATT is low, i.e. the toughness is high, when the W content ranges between 0.1 and 0.5%. The FATT takes low value particularly when the W content ranges between 0.2 and 0.5%.

TABLE 4

| No. | C | Si | Mn | Ni | Cr | Mo | V | Nb | N | W | Al | Cr Equivalent | W/Al |
|---|---|---|---|---|---|---|---|---|---|---|---|---|---|
| 1A | 0.30 | 0.32 | 0.80 | 0.48 | 1.09 | 1.26 | 0.25 | — | — | — | 0.011 | — | — |
| 2B, 2C | 0.19 | 0.31 | 0.55 | 0.71 | 11.30 | 0.92 | 0.20 | 0.09 | 0.065 | 0.02 | 0.012 | 6.03 | 1.7 |
| 3C | 0.17 | 0.21 | 0.57 | 0.60 | 11.15 | 1.29 | 0.22 | 0.07 | 0.049 | 0.24 | 0.007 | 8.89 | 34.3 |
| 4C | 0.18 | 0.11 | 0.59 | 0.65 | 11.02 | 1.27 | 0.20 | 0.05 | 0.050 | 0.40 | 0.008 | 7.33 | 50.0 |
| 5C | 0.18 | 0.24 | 0.60 | 0.59 | 11.20 | 1.24 | 0.19 | 0.06 | 0.048 | 0.41 | 0.019 | 8.41 | 21.6 |
| 6C | 0.17 | 0.20 | 0.58 | 0.57 | 11.17 | 1.23 | 0.22 | 0.07 | 0.040 | 0.88 | 0.008 | 9.90 | 11.0 |
| 7C | 0.17 | 0.22 | 0.57 | 0.60 | 11.10 | 1.24 | 0.21 | 0.06 | 0.045 | 0.49 | 0.015 | 9.04 | 32.7 |

TABLE 5

| No. | heat treatment: quenching | heat treatment: tempering |
|---|---|---|
| 1A | 960° C. × 2h 100° C./h | 660° C. × 45h 20° C./h |
| 2B | 1050° C. × 2h 100° C./h | 565° C. × 15h 20° C./h +665° C. × 45h 20° C./h |
| 2C, 3C, 4C, 5C, 6C, 7C | 1100° C. × 2h 100° C./h | 565° C. × 15h 20° C./h +665° C. × 45h 20° C./h |

TABLE 6

| No. | tensile strength (Kg/mm²) | elon-ga-tion (%) | reduc-tion of area (%) | impact strength (Kg-m) | FATT (°C.) | 600° C., 10⁵h creep rupture strength (Kg/mm²) |
|---|---|---|---|---|---|---|
| 1A | 82.4 | 18.5 | 56.3 | 1.11 | 110 | 4.6 |
| 2B | 90.3 | 19.5 | 56.0 | 1.80 | 81 | 8.5 |
| 2C | 91.2 | 18.9 | 53.2 | 1.50 | 58 | 9.0 |
| 3C | 90.5 | 20.1 | 60.0 | 2.05 | 49 | 11.6 |
| 4C | 91.1 | 19.9 | 57.8 | 1.93 | 52 | 12.2 |
| 5C | 90.4 | 20.0 | 58.1 | 1.97 | 52 | 10.8 |
| 6C | 91.5 | 19.3 | 56.8 | 1.00 | 102 | 10.0 |

TABLE 6-continued

| No. | tensile strength (Kg/mm²) | elongation (%) | reduction of area (%) | impact strength (Kg-m) | FATT (°C.) | 600° C., 10⁵h creep rupture strength (Kg/mm²) |
|---|---|---|---|---|---|---|
| 7C | 91.0 | 19.5 | 58.3 | 2.00 | 56 | 11.7 |

EXAMPLE 3

An investigation was made as to how the properties mentioned in connection with Examples 1 and 2 such as the creep rupture strength (600° C., $10^5$ h) and FATT are influenced by the ratio W(wt%)/Al(wt%) for each of the alloys mentioned in the description of Examples 1 and 2.

Figure 5:
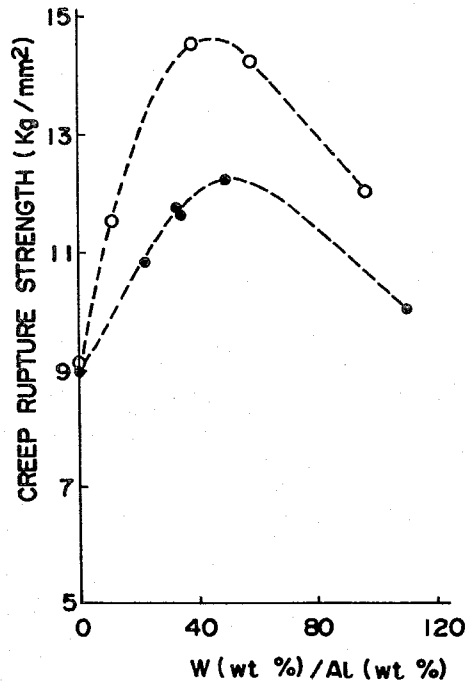
FIG. 5 is a diagram showing the relationship between the creep rupture strength and the ratio W/Al between W content and Al content.

FIG. 5 is a diagram showing the relationship between the creep rupture strength and the ratio W/Al, from which it will be seen that the highest strength is obtained when the value of the ratio W/Al ranges between 30 and 60. In this Figure, marks o and marks • are given to the alloys of Table 1 and alloys of Table 4, respectively.

EXAMPLE 4

Various steels having chemical compositions shown in terms of weight percent in Table 7 were prepared by melting, while varying Al content and N content. In each steel, the balance of the composition was constituted by Fe. The steels were shaped into bars having a rectangular cross-section of 35 mm×115 mm. The steel bars were soaked for 1 hour at 1100° C. and were subjected to an oil quenching. The steel bars were then subjected to a tempering in which the steel bars were soaked for 2 hours at 650° C. and then cooled in the air. This heat treatment simulates the heat treatment usually applied to steam turbine blades. In Table 7, samples Nos. 7 to 9, 12 and 13 are heat resisting steels in accordance with the invention, while samples Nos. 10 and 11 are reference steels. Then, a creep rupture test was conducted with these test materials to investigate the influences of Al,W and N on the creep rupture strength (600° C., $10^4$ h). The contents of other constituents such as C,Si,Mn,Cr,Ni,Mo,V,W and Nb were held substantially constant.

Figure 6:
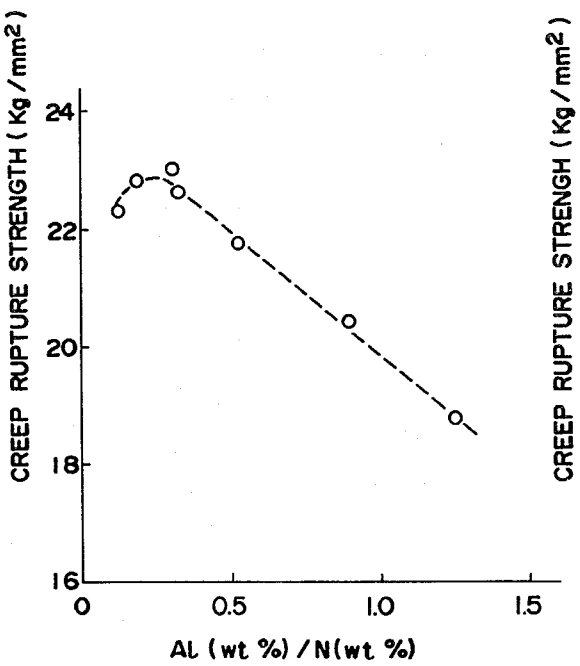
FIG. 6 is a diagram showing the relationship between the creep rupture strength and the ratio Al/N between the Al content and N content.

FIG. 6 shows the relationship between the creep rupture strength and the ratio Al/N. From this Figure, it will be seen that a high creep rupture strength is obtained when the ratio Al/N takes a value not greater than 0.5.

Figure 7:
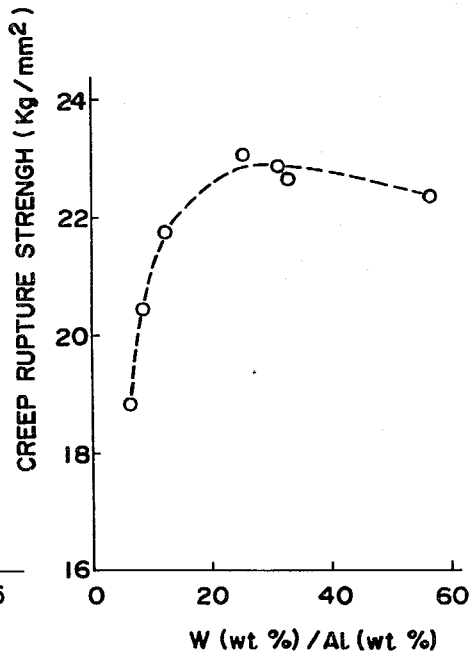
FIG. 7 is a diagram showing the relationship between the creep rupture strength and the ratio W/Al between the W content and Al content.

FIG. 7 is a diagam showing the relationship between the creep rupture strength and the ratio W/Al. From this Figure, it will be seen that a high creep rupture strength is obtained when the ratio W/Al takes a value exceeding 10.

TABLE 7

| No. | C | Si | Mn | Ni | Cr | Mo | W | V | Nb | N | Al | Al/N | W/Al | 600° C., 10⁴h strength (Kg/mm²) |
|---|---|---|---|---|---|---|---|---|---|---|---|---|---|---|
| 7 | 0.15 | 0.14 | 0.51 | 0.61 | 10.57 | 1.24 | 0.30 | 0.17 | 0.09 | 0.040 | 0.012 | 0.30 | 25.0 | 23.0 |
| 8 | 0.16 | 0.10 | 0.48 | 0.61 | 10.70 | 1.25 | 0.28 | 0.18 | 0.08 | 0.041 | 0.005 | 0.12 | 56.0 | 22.3 |
| 9 | 0.15 | 0.10 | 0.47 | 0.58 | 10.64 | 1.27 | 0.25 | 0.16 | 0.08 | 0.041 | 0.021 | 0.52 | 11.9 | 21.7 |
| 10 | 0.14 | 0.12 | 0.50 | 0.60 | 10.59 | 1.24 | 0.31 | 0.16 | 0.09 | 0.040 | 0.036 | 0.90 | 8.6 | 20.4 |
| 11 | 0.16 | 0.14 | 0.51 | 0.58 | 10.50 | 1.25 | 0.30 | 0.19 | 0.08 | 0.039 | 0.048 | 1.25 | 6.3 | 18.8 |
| 12 | 0.15 | 0.10 | 0.50 | 0.59 | 10.63 | 1.25 | 0.29 | 0.17 | 0.08 | 0.028 | 0.009 | 0.32 | 32.2 | 22.6 |
| 13 | 0.14 | 0.09 | 0.48 | 0.59 | 10.57 | 1.24 | 0.31 | 0.18 | 0.10 | 0.055 | 0.010 | 0.18 | 31.0 | 22.8 |

EXAMPLE 5

Steels containing, by weight, about 11% Cr, 0.18%V, 0.08%Nb, 0.04%N and 0.07%Al were prepared by melting while varying the Mo,W and C contents within the regions of 0.95 to 1.52%, 0 to 0.70% and 0.13 to 0.22%, respectively. Test pieces obtained from these steels were subjected to a creep rupture test (600° C., $10^4$ h) and an impact test for examining impact strength at room temperature. Chemical compositions (wt %) of the test materials, creep strengths and impact strengths of these test materials are shown in Table 8. In each material, the balance of composition was constituted by Fe. Samples Nos. 14,16,18 to 21 and 23 are steels of the invention, while samples Nos. 15,17,22 and 24 are comparative steels.

Figure 8:
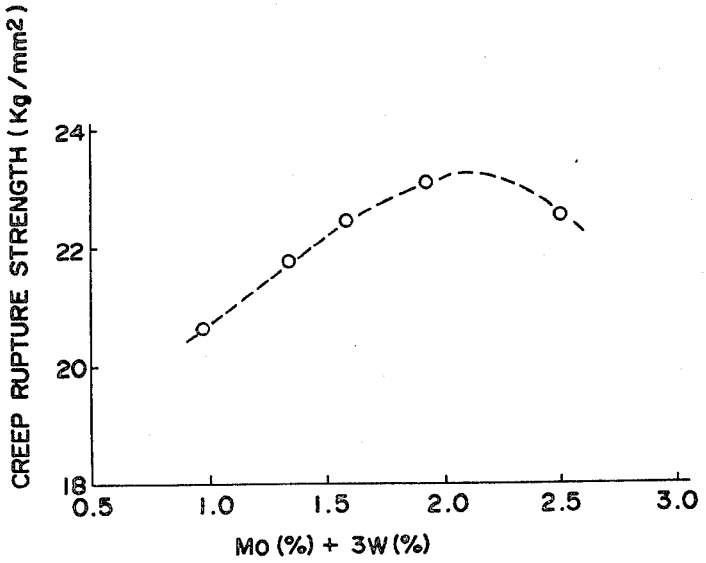
FIG. 8 is a diagram showing the relationship between the creep rupture strength and (Mo+3W)
Figure 9:
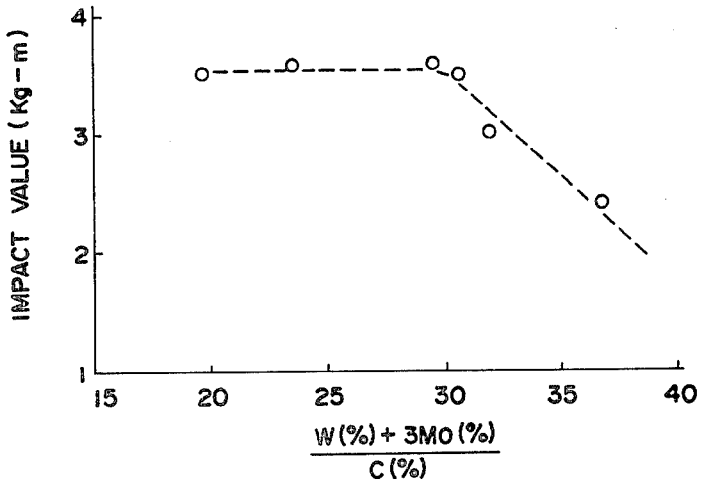
FIG. 9 is a diagram showing the relationship between the impact strength and the ratio (W+3Mo)/C.

The test materials were subjected to a heat treatment simulating the heat treatment usually applied to steam turbine blades and including holding at 1100° C. for 1 hour, oil quenching and tempering by air cooling subsequent to holding at 650° C. for 2 hours. FIGS. 8 and 9 show, respectively, the relationship between the creep rupture strength and the amount Mo+3W and the relationship between the impact strength and the value of the ratio (W+3Mo)/C. In the Table, samples Nos. 14 to 18 are materials for steam turbine rotor, while samples Nos. 19 to 24 are for steam turbine blades.

TABLE 8

| No. | C | Si | Mn | Ni | Cr | Mo | W | V | Nb | N | Al | Cr |
|---|---|---|---|---|---|---|---|---|---|---|---|---|
| 14 | 0.16 | 0.14 | 0.57 | 0.63 | 10.74 | 1.22 | 0.42 | 0.16 | 0.07 | 0.041 | 0.007 | 7.91 |
| 15 | 0.19 | 0.14 | 0.48 | 0.64 | 10.82 | 0.99 | 0.70 | 0.13 | 0.07 | 0.039 | 0.006 | 6.18 |
| 16 | 0.16 | 0.15 | 0.47 | 0.63 | 10.82 | 1.41 | 0.11 | 0.16 | 0.08 | 0.035 | 0.007 | 8.76 |
| 17 | 0.17 | 0.14 | 0.48 | 0.58 | 10.97 | 1.24 | 0.02 | 0.15 | 0.07 | 0.026 | 0.008 | 7.93 |
| 18 | 0.14 | 0.14 | 0.54 | 0.64 | 10.97 | 1.20 | 0.22 | 0.16 | 0.06 | 0.036 | 0.008 | 8.69 |
| 19 | 0.13 | 0.29 | 0.57 | 0.65 | 11.15 | 1.24 | 0.23 | 0.22 | 0.09 | 0.051 | 0.006 | 10.60 |
| 20 | 0.13 | 0.26 | 0.56 | 0.60 | 11.14 | 0.95 | 0.21 | 0.19 | 0.10 | 0.037 | 0.009 | 9.57 |
| 21 | 0.13 | 0.25 | 0.49 | 0.66 | 11.01 | 1.52 | 0.20 | 0.24 | 0.07 | 0.040 | 0.004 | 11.87 |
| 22 | 0.13 | 0.32 | 0.54 | 0.63 | 11.04 | 1.26 | 0.03 | 0.20 | 0.09 | 0.035 | 0.006 | 10.89 |
| 23 | 0.13 | 0.28 | 0.52 | 0.60 | 11.09 | 1.24 | 0.42 | 0.19 | 0.09 | 0.035 | 0.004 | 11.22 |
| 24 | 0.15 | 0.27 | 0.49 | 0.55 | 11.02 | 0.98 | — | 0.21 | 0.08 | 0.043 | 0.013 | — |

| No. | $M_o + 3W$ | $\frac{3M_o + W}{C}$ | $\frac{Al}{N}$ | $\frac{W}{Al}$ | 600° C., 10⁴ strength rotor | 600° C., 10⁴ strength blade | impact strength (kg · m) rotor | impact strength (kg · m) blade |
|---|---|---|---|---|---|---|---|---|

TABLE 8-continued

| | | | | | | | | |
|---|---|---|---|---|---|---|---|---|
| 14 | 2.48 | 25.5 | 0.17 | 60.0 | 17.3 | — | 2.02 | — |
| 15 | 3.09 | 19.3 | 0.15 | 116 | 16.5 | — | — | — |
| 16 | 1.74 | 27.1 | 0.20 | 15.7 | 17.0 | — | 1.87 | — |
| 17 | 1.30 | 22.0 | 0.31 | 2.5 | 16.6 | — | 2.16 | — |
| 18 | 1.86 | 27.3 | 0.22 | 27.5 | 18.1 | — | 2.04 | — |
| 19 | 1.93 | 30.4 | 0.12 | 38.3 | — | 23 | 2.05 | 3.5 |
| 20 | 1.58 | 23.5 | 0.24 | 23.3 | — | 22.4 | 2.28 | 3.6 |
| 21 | 2.12 | 36.6 | 0.10 | 50.0 | — | 21.4 | 0.99 | 2.4 |
| 22 | 1.35 | 29.3 | 0.17 | 5.0 | — | 21.7 | 2.24 | 3.6 |
| 23 | 2.50 | 31.8 | 0.11 | 105 | — | 22.5 | 1.70 | 3.0 |
| 24 | 0.98 | 19.6 | 0.31 | 0 | — | 20.6 | 2.05 | 3.5 |

Figure 10:
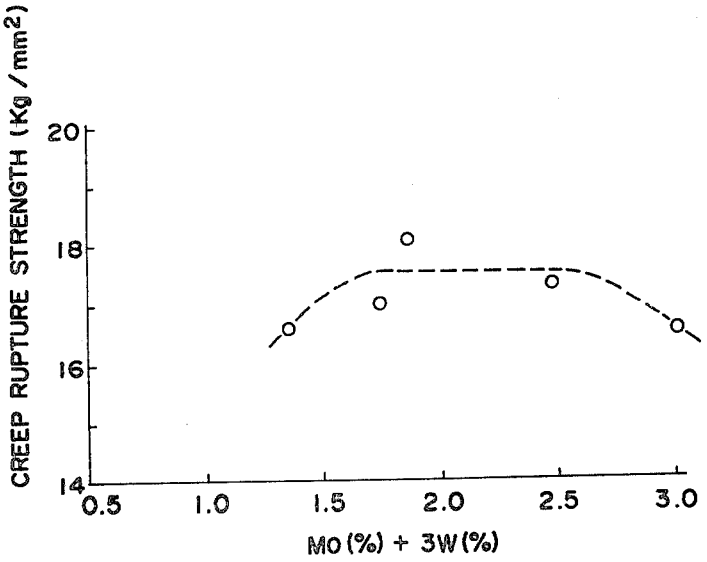
FIG. 10 is a diagram showing the relationship between the creep rupture strength and (Mo+3W)
Figure 11:
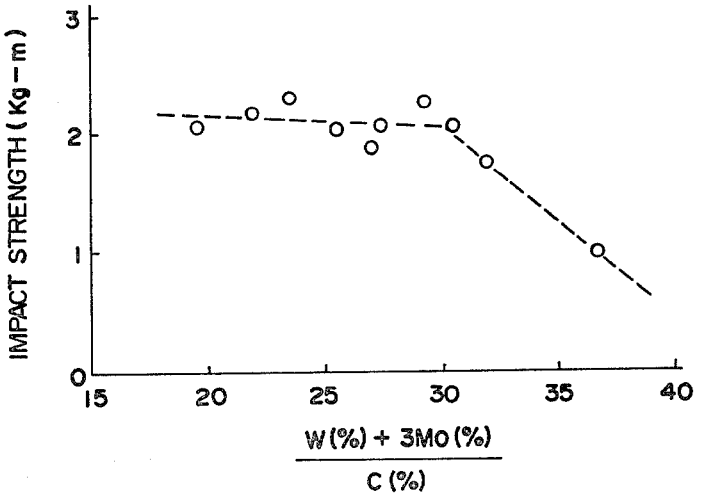
FIG. 11 is a diagram showing the relationship between impact strength and the ratio (W+3Mo)/C.

Test materials were subjected to a heat treatment which simulates the heat treatment effected on the central portion of steam turbine rotor. More specifically, the heat treatment includes the steps of holding at 1100° C. for 24 hours, cooling at a rate of 100° C./h, holding at 565° C. for 15 hours followed by air cooling and holding at 665° C. for 45 hours followed by furnace cooling. Tests were conducted with the thus treated test materials, the result of which are shown in FIGS. 10 and 11. As will be seen from FIGS. 8 and 10, the creep rupture strength is increased as the value of Mo+ 3W is increased. Specifically high strength is obtained when the Mo+3W takes a value ranging between 1.5 and 2.9 in the case of the rotor material, whereas, in the case of the blade material, a high strength is attained when the Mo+3W takes a value between 1.5 and 2.9. It was thus confirmed that the W provides an effect of improving the creep rupture strength three times as large as the effect provided by Mo. An increase in Mo and addition of W effectively improves the creep rupture strength through stabilization of carbides at high temperature and solid solution strenghtening.

As will be seen from FIGS. 9 and 11, the impact strength is drastically lowered as the ratio (W+3Mo)/C takes a value exceeding 30. Therefore, in the case of the blade material, the ratio (W+3Mo)/C preferably takes a value not greater than 34, whereas, in the case of the rotor material, the ratio (W+3Mo)/C preferably takes a value not greater than 32, by suitable selection of the W and Mo contents.

FIG. 12 is a diagram showing the relationship beween the creep rupture strength and the ratio W/Al. In this Figure, the marks o represent the samples Nos. 19,20,22,23 and 24, and the marks • represent samples Nos. 14–18. From this Figure, it will be seen that a high creep rupture strength is obtained when the ratio W/Al takes a value ranging between 10 and 110. The sample No. 21 exhibits an inferior strength due to precipitation of δ ferrite because of a too large Cr equivalent.

EXAMPLE 6

A steam turbine blade as shown in FIG. 13 was fabricated from the alloy No. 3 in Table 1. More specifically, the balde was produced by a forgoing after preparation by melting, holding at 1100° C. for 1 hour, quenching by immersion in an oil, and holding at 650° C. for 2 hours followed by furnace cooling. The material was then shaped into the steam turbine blade as shown in FIG. 13 by machining. The blade had a whole tempered martensite structure.

A steam turbine rotor shaft as shown in FIG. 14 was fabricated from the alloy No. 3C in Table 3. More specifically, the blank material was produced by a process having the steps of forging following the preparation by melting, holding at 1100° C. for 2 hours, cooling at a rate of 100° C./h, holding at 565° C. for 15 hours, cooling at a rate of 20° C./h, holding at 665° C. for 45 hours and cooling at a rate of 20° C./h. The blank was then finished into the steam turbine rotor shaft as shown in FIG. 14 by machining. The turbine rotor shaft thus produced had a whole tempered martensite structure.

During holding the steam turbine rotor shaft at specific temperatures such as quenching temperature and tempering temperature, as well as during cooling, it is preferred that the rotor shaft is slowly rotated to uniformize the temperature. By conducting the heat treatment while rotating the rotor, it is possible to avoid age bending of the turbine rotor shaft during long use.

As will be understood from the foregoing description, the heat resisting steel of the invention exhibits quite a superior high temperature creep rupture strength up to 600° C., and well satisfies the demand for the strength necessitated by the blades and rotor shafts of steam turbines which are designed to operate at a high efficiency with steam of extremely high temperature up to 600° C.

Although the invention has been described with specific reference to blades and rotor shafts of steam turbines, it is to be noted that the steels of the invention can be used as the materials of various parts or members which are used at high temperatures.

What is claimed is:

1. A heat resisting steel having substantially whole tempered martensite structure and exhibiting, when tempered after quenching at 100° C./h, a $10^5$-hour creep rupture strength at 600° C. of at least 10 Kg/mm$^2$, said steel consisting essentially of, by weight, 8 to 13% of Cr, 0.5 to 2% of Mo, 0.02 to 0.5% of V, 0.02 to 0.15% of Nb, 0.025 to 0.1% of N, 0.05 to 0.25% of C, not greater than 0.6% of Si, not greater tban 1.5% of Mn, no greater than 1.5% of Ni, 0.0005 to 0.02% of Al, 0.1 to 0.5% of W and the balance substantially Fe, the ratio W/Al between W content and Al content ranging between 20 and 80, and the Al and N contents being such that a value given by Al (wt. %)/N (wt. %) is not greater than 0.5.

2. A heat resisting steel according to claim 1, wherein the composition is prepared such that a value given by Mo(wt%)+3W(wt%) ranges between 1.4 and 2.6.

3. A heat resisting steel according to either one of claims 1 and 2, wherein the Cr equivalent of said steel is not greater than 12.

4. A heat resisting steel according to any one of claims 1 to 3, wherein the composition is prepared such that a value given by (3Mo(wt%)+W(wt%))/C(wt%) is not greater than 34.

5. A heat resisting steel according to any one of claims 1 to 4, wherein the Cr equivalent of said steel is not greater than 12.

6. A heat resisting steel having substantially whole tempered martensite structure and exhibiting, when tempered after quenching at 100° C./h, a $10^5$-hour creep rupture strength at 600° C. of at least 10 Kg/mm$^2$, said steel consisting essentially of, by weight, 10 to 11.5% of Cr, 1 to 1.5% of Mo, 0.01 to 0.3% of V, 0.07 to 0.12% of Nb, 0.04 to 0.07% of N, 0.1 to 0.2% of C, 0.02 to 0.25% of Si, 0.3 to 1.0% of Mn, 0.3 to 1.0% of Ni, 0.001 to 0.01% of Al, 0.2 to 0.45% of W and the balance substantially Fe, the ratio W/Al between W content and Al content ranging between 30 and 60 and the Al and N contents being such that a value given by Al (wt. %)/N (wt. %) is not greater than 0.5.

7. A heat resisting steel for use as the material for steam turbine blades, having substantially whole tempered martensite structure and exhibiting, when tempered after quenching at 100° C./h, a $10^5$-hour creep rupture strength at 600° C. of at least 10 Kg/mm$^2$, said steel consisting essentially of, by weight, 8 to 13% of Cr, 0.5 to 2% of Mo, 0.02 to 0.5% of V, 0.03 to 0.15% of Nb, 0.025 to 0.1% of N, 0.05 to 0.2% of C, not greater than 0.6% of Si, not greater than 1.5% of Mn, not greater than 1.5% of Ni, 0.0005 to 0.015% of Al, 0.1 to 0.5% of W and the balance substantially Fe, the ratio W/Al between W content and Al content ranging between 20 and 80, and the Al and N contents being such that a value given by Al (wt. %)/N (wt. %) is not greater than 0.5.

8. A heat resisting steel according to claim 7, wherein the composition is prepared such that a value given by Mo(wt%)+3W(wt%) ranges between 1.4 and 2.6.

9. A heat resisting steel according to either one of claims 6 and 7, wherein the Cr equivalent of said steel ranges between 6 and 12.

10. A heat resisting steel according to claim 1, wherein the composition is prepared such that a value given by (3Mo(wt%)+W(wt%))/C(wt%) is not greater than 34.

11. A heat resisting steel according to claim 7, having substantially whole tempered martensite structure and consisting essentially of, by weight, 9 to 12% of Cr, 1 to 1.5% of Mo, 0.1 to 0.3% of V, 0.05 to 0.15% of Nb, 0.025 to 0.1% of N, 0.1 to 0.16% of C, 0.02 to 0.25% of Si, 0.3 to 1.0% of Mn, 0.3 to 1.0% of Ni, 0.001 to 0.01% of Al, 0.2 to 0.45% of W and the balance substantially Fe, the ratio W/Al between W content and Al content ranging between 20 and 80.

12. A heat resisting steel for use as the material for steam turbine rotor shafts, having substantially whole tempered martensite structure and exhibiting, when tempered after quenching at 100° C./h, a $10^5$-hour creep rupture strength at 600° C. of at least 10 Kg/mm$^2$, said steel consisting essentially of, by weight, 8 to 13% of Cr, 0.5 to 2% of Mo, 0.02 to 0.5% of V, 0.02 to 0.12% of Nb, 0.025 to 0.1% of N, 0.1 to 0.25% of C, not greater than 0.6% of Si, not greater than 1.5% of Mn, not greater than 1.5% of Ni, 0.0005 to 0.01% of Al, 0.1 to 0.5% of W and the balance substantially Fe, the ratio W/Al between W content and Al content ranging between 20 and 80, and the Al and N contents being such that a value given by Al (wt. %)/N (wt. %) is not greater than 0.5.

13. A heat resisting steel according to claim 12, wherein the composition is prepared such that a value given by Mo(wt%)+3W(wt%) ranges between 1.4 and 2.6.

14. A heat resisting steel according to either one of claims 12 and 13, wherein the Cr equivalent of said steel ranges between 6 and 10.

15. A heat resisting steel according to claim 12, wherein the composition is prepared such that a value given by (3Mo(wt%)+W(wt%))/C(wt%) is not greater than 32.

16. A heat resisting steel according to claim 10, having substantally whole tempered martensite structure and consisting essentially of, by weight, 9 to 12% of Cr, 1 to 1.5% of Mo, 0.1 to 0.3% of V, 0.03 to 0.10% of Nb, 0.025 to 0.1% of N, 0.14 to 0.22% of C, 0.02 to 0.25% of Si, 0.3 to 1.0% of Mn, 0.3 to 1.0% of Ni, 0.001 to 0.01% of Al, 0.2 to 0.45% of W and the balance substantially Fe, the ratio W/Al between W content and Al content ranging between 20 and 80.

* * * * *